US007956549B2

(12) United States Patent
Chung et al.

(10) Patent No.: US 7,956,549 B2
(45) Date of Patent: Jun. 7, 2011

(54) POWER CONVERSION STRUCTURE

(75) Inventors: Chin-Biau Chung, Taipei Hsien (TW); Tsai-Shiuan Hung, Taipei Hsien (TW); Yu-Yuan Chang, Taipei Hsien (TW)

(73) Assignee: Zippy Technology Corp., Hsin-Tien, Taipei Hsien (TW)

( * ) Notice: Subject to any disclaimer, the term of this patent is extended or adjusted under 35 U.S.C. 154(b) by 385 days.

(21) Appl. No.: 12/174,217

(22) Filed: Jul. 16, 2008

(65) Prior Publication Data

US 2010/0013397 A1 Jan. 21, 2010

(51) Int. Cl.
*H05B 41/16* (2006.01)

(52) U.S. Cl. ..... 315/248; 315/247

(58) Field of Classification Search ..... 315/224, 315/244, 307, 308, 291, 209 R, DIG. 4, 247, 315/248, 249

See application file for complete search history.

(56) References Cited

U.S. PATENT DOCUMENTS

| | | | | |
|---|---|---|---|---|
| 6,274,987 | B1 * | 8/2001 | Burke | 315/307 |
| 6,362,575 | B1 * | 3/2002 | Chang et al. | 315/224 |
| 6,724,156 | B2 * | 4/2004 | Fregoso | 315/291 |
| 7,187,136 | B2 * | 3/2007 | Fiorello | 315/224 |

FOREIGN PATENT DOCUMENTS

| | | |
|---|---|---|
| TW | 200701295 | 1/2007 |
| TW | M312155 | 5/2007 |

* cited by examiner

*Primary Examiner* — Douglas W Owens
*Assistant Examiner* — Minh D A
(74) *Attorney, Agent, or Firm* — Muncy, Geissler, Olds & Lowe, PLLC

(57) ABSTRACT

A power conversion structure includes a power factor correction circuit which has an energy storage coil, a switch and a voltage boosting control unit. The voltage boosting control unit drives the switch to set OFF and ON of the switch to change the period of current passing through the energy storage coil to alter the phase of the current. The energy storage coil is coupled with at least one induction coil to induce and generate driving power to energize lighting equipment. The amount of the driving power is determined by the coil ratio of the induction coil and the energy storage coil. Through the induction coil, the energy storage coil can be induced to generate the driving power which is determined by the coil ratio of the induction coil and energy storage coil.

7 Claims, 2 Drawing Sheets

POWER CONVERSION STRUCTURE

FIELD OF THE INVENTION

The present invention relates to a power conversion structure and particularly to a circuit to provide driving power for operation of lighting equipment.

BACKGROUND OF THE INVENTION

It usually happens that after an electronic device is connected to a power source if a great difference occurs between the phases of voltage and current of input power, a great portion of power will be stored in capacitor or inductor elements and result in the actual power (output power) lower than the input power. In order to increase output power efficiency and reduce ineffective power, most power supplies at present have a power factor correction circuit to regulate the voltage phase and current phase of the input power to make them coincided as much as possible to get a greater actual power. The power factor correction circuit can be divided into an active type and a passive type. The active type power factor correction circuit mainly includes a control unit, a switch and an energy storage coil. The control unit determines ON time series of the switch to alter the current ON period of the energy storage coil. Thus the input power passing through the power factor correction circuit can be regulated to attain approximate one for the power factor (the power factor is one when the voltage phase is the same as the current phase). The conventional lighting equipment generally are not equipped with the power factor correction circuit, thus have lower power efficiency. The so called "power saving lighting features" nowadays mostly get power of a higher power factor through an electronic ballast circuit. The electronic ballast circuit generally includes a power factor correction circuit to regulate the phase difference of current and voltage and a transformer or inverter to transform current amount or voltage level to energize lighting bulbs. For instance, R.O.C. patent publication No. 200701295 entitled "Electronic ballast for power factor correction devices with continuous current" provides a circuit structure including a power factor correction device and an inverter. Another R.O.C. patent No. M312155 entitled "Electronic ballast for high pressure gas discharging lamps" discloses an electronic ballast with a power factor correction circuit. Input power of the electronic ballast passes through the power factor correction circuit and a full bridge driving circuit to be rectified, then is output through a voltage boosting circuit. However, on the conventional circuits mentioned above a transformer (inverter) or a voltage boosting circuit has to be provided to transform the voltage or current after it has passed through the power factor correction circuit. As a result, a greater loss incurs, and the number of elements needed also increases (could be a two-stage or three-stage circuit). And the product size also is bigger, and the cost is higher.

SUMMARY OF THE INVENTION

In order to overcome the shortcomings of the conventional circuits of electronic ballasts that need a transformer or voltage boosting circuit to provide output, and result in a larger physical size and greater energy loss, the primary object of the present invention is to provide a circuit to reduce power conversion loss and the size thereof to improve efficiency and lower the cost.

The invention provides a power conversion structure which has a power factor correction circuit. The power factor correction circuit includes an energy storage coil, a switch and a voltage boosting control unit. The voltage boosting control unit drives OFF and ON of the switch to change the period of current passing through the energy storage coil to regulate the phase of current. At least one induction coil is provided to be coupled with the energy storage coil to generate the driving power by induction. The coil ratio of the induction coil and the energy storage coil determines the amount of the driving power. Namely, through the induction coil the energy storage coil is induced to generate the driving power. By changing the ratio of the induction coil and the energy storage coil, the amount of the driving power can be determined. Therefore, the induction coil can induce power of a higher power factor and directly deliver a rated voltage to the lighting equipment. Moreover, the aforesaid circuit also is simpler than the conventional circuits, and at least one transformer (inverter) and a switch circuit corresponding to the transformer can be saved. All this can reduce loss and the physical size of power conversion, and result in a higher efficiency and a lower cost.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
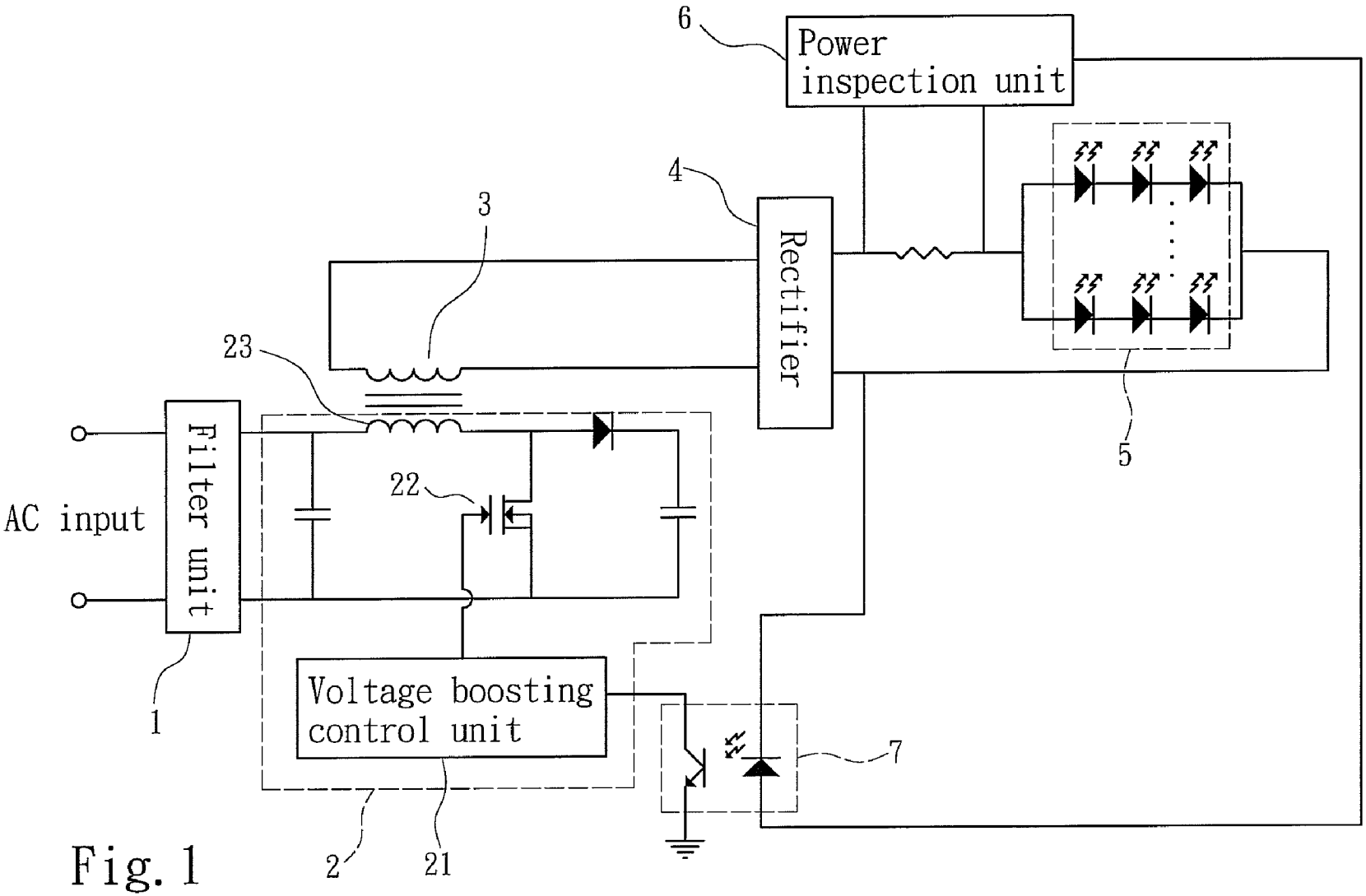
FIG. 1 is a circuit diagram of an embodiment of the invention.

Please refer to FIG. 1 for a circuit diagram of the invention. A power conversion structure of the invention is a circuit to provide driving power for operation of lighting equipment. The circuit has a front end to receive input power which is sent to a power factor correction circuit 2 through a filter unit 1. The power factor correction circuit 2 includes an energy storage coil 23, a switch 22 and a voltage boosting control unit 21. The voltage boosting control unit 21 generates a pulse signal to drive OFF and ON of the switch 22; therefore, the period of current flowing through the energy storage coil 23 can be changed to alter the phase of the current. The power factor correction coil 2 is not limited to operate in a discontinuous current mode (DCM) or continuous current mode (CCM). The switch 22, by controlling the period of the current passing through the energy storage coil 23, can get the voltage gradually increased to a selected level (about 380V or up, based on a general power supply). The principle of regulating the power phase of the power factor correction circuit 2 via switching or voltage boosting is known in the art, thus details are omitted herein. The present invention provides features as follow: at least one induction coil 3 is provided to be coupled with the energy storage coil 23 to generate the driving power through induction. The induction coil 3 can be coupled with the energy storage coil 23 via an iron core. The coil ratio of the induction coil 3 and the energy storage coil 23 determines the amount of the driving power. As the driving power can be generated and output by the induction coil 3, the amount of the driving power can be determined by the ratio of the induction coil 3 and the energy storage coil 23 without adding an extra transformer and other related circuits that control operation of the transformer. Compared with the conventional circuit structures, the driving circuit may be a three-stage or four-stage circuit due to conversion and separation of voltage and current. Through induction of the power factor correction circuit 2 to directly generate the driving power, the transformer can be dispensed with to simplify the circuit to a two-stage or three-stage one. In short, the structure can achieve such effects: generating power of a greater power factor through induction of the power factor correction circuit 2, saving one transformer and reducing the size of the control circuit thereof, and lowering cost and loss. The induction coil 3 may further be connected to a rectifier 4 to regulate the driving power. After rectification the driving power can become DC power. Lighting equipment 5 connecting to a rear end of the rectifier 4 may include at least a LED cluster driven by the driving power to emit light. The induction coil 3 and the lighting equipment 5 may also be bridged by a power inspection unit 6 to generate a feedback signal according to the driving power. The feedback signal is sent to the voltage boosting control unit 21 through a coupling element 7 to facilitate control.

Figure 2:
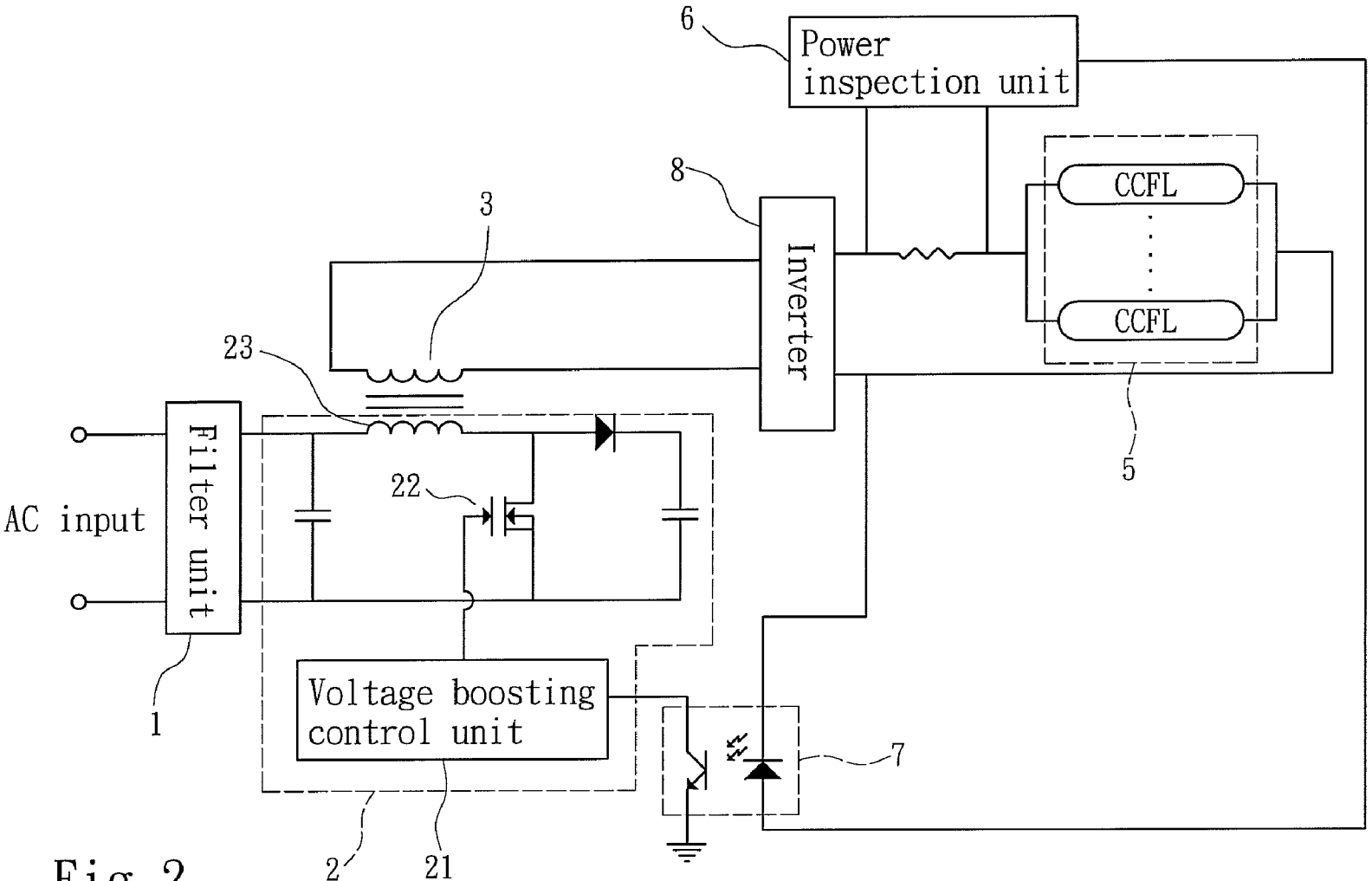
FIG. 2 is a circuit diagram of another embodiment of the invention.

Refer to FIG. 2 for another embodiment of the invention. In this embodiment, the induction coil 3 is further connected to an inverter 8 to regulate the driving power. The inverter 8 can regulate the driving power to become AC power. The operation principle of the inverter 8 is known in the art, thus details are omitted herein. The lighting equipment 5 connecting to a rear end of the inverter 8 includes at least one discharge lamp. The inverter 8 regulates the driving power to become the AC power to light the discharge lamp of the lighting equipment 5.

As a conclusion, the invention provides driving power to energize the lighting equipment 5 at a smaller circuit size. The number of electronic elements is fewer. The loss of the circuit can be reduced, and power utilization efficiency of total circuitry is higher.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A power conversion structure comprising a power factor correction circuit which has an energy storage coil, a switch and a voltage boosting control unit, wherein the voltage boosting control unit controlling OFF and ON of the switch to change the period of current flowing through the energy storage coil to regulate the phase of current, characterized in:

the energy storage coil is coupled with at least one induction coil to induce and generate driving power to energize lighting equipment, the amount of the driving power being determined by the coil ratio of the induction coil and the energy storage coil.

2. The power conversion structure of claim 1, wherein the induction coil is connected to a rectifier to regulate the driving power.

3. The power conversion structure of claim 2, wherein the lighting equipment is connected to a rear end of the rectifier and includes at least one LED cluster.

4. The power conversion structure of claim 1, wherein the induction coil is connected to an inverter to regulate the driving power.

5. The power conversion structure of claim 4, wherein the lighting equipment is connected to a rear end of the inverter and includes at least one discharging lamp.

6. The power conversion structure of claim 1, wherein the induction coil and the lighting equipment are bridged by a power inspection unit which generates a feedback signal sent to the voltage boosting control unit according to the driving power.

7. The power conversion structure of claim 1, wherein the at least one induction coil is outside the power factor correction circuit.

* * * * *